US007117689B2

(12) United States Patent
Rudick et al.

(10) Patent No.: US 7,117,689 B2
(45) Date of Patent: Oct. 10, 2006

(54) REMOVABLE REFRIGERATION CASSETTE FOR A HOT AND COLD VENDING MACHINE

(75) Inventors: Arthur G. Rudick, Atlanta, GA (US); Leonard F. Antao, Smyrna, GA (US)

(73) Assignee: The Coca-Cola Company, Atlanta, GA (US)

( * ) Notice: Subject to any disclaimer, the term of this patent is extended or adjusted under 35 U.S.C. 154(b) by 313 days.

(21) Appl. No.: 10/708,005

(22) Filed: Feb. 2, 2004

(65) Prior Publication Data

US 2005/0178129 A1 Aug. 18, 2005

(51) Int. Cl.
*F25D 19/02* (2006.01)

(52) U.S. Cl. ..... 62/448; 62/441

(58) Field of Classification Search ..... 62/441, 62/442, 448, 457.5
See application file for complete search history.

(56) References Cited

U.S. PATENT DOCUMENTS

| | | | | |
|---|---|---|---|---|
| 4,815,302 | A | 3/1989 | Aoki et al. | 62/378 |
| 4,823,984 | A | 4/1989 | Ficken | 221/96 |
| 5,417,081 | A | 5/1995 | Rudick et al. | 62/440 |
| 5,485,878 | A | 1/1996 | Derks | 165/16 |
| 5,544,572 | A | 8/1996 | Garmendia | 99/489 |
| 5,901,877 | A | 5/1999 | Fujiu | 221/150 HC |
| 5,996,366 | A | 12/1999 | Renard | 99/256 |
| 6,047,855 | A | 4/2000 | Lin | 221/150 HR |
| 6,272,867 | B1 | 8/2001 | Barrash et al. | 62/6 |
| 6,378,324 | B1 | 4/2002 | Percy et al. | 62/448 |
| 6,481,216 | B1 | 11/2002 | Simmons et al. | 62/6 |
| 6,532,749 | B1 | 3/2003 | Rudick et al. | 62/6 |
| 6,550,255 | B1 | 4/2003 | Rudick et al. | 62/6 |
| 6,581,389 | B1 | 6/2003 | Rudick | 62/6 |
| 2002/0134088 | A1 | 9/2002 | Rudick et al. | 62/6 |
| 2002/0134089 | A1 | 9/2002 | Rudick et al. | 62/6 |
| 2002/0166334 | A1 | 11/2002 | Houk et al. | 62/291 |

FOREIGN PATENT DOCUMENTS

| | | |
|---|---|---|
| GB | 757 945 | 4/1954 |
| GB | 2 066 441 A | 10/1980 |
| JP | 2002/333269 | 11/2002 |
| JP | 2003/288638 | 10/2003 |
| JP | 2004/054318 | 2/2004 |

*Primary Examiner*—Melvin Jones
(74) *Attorney, Agent, or Firm*—Sutherland Asbill & Brennan LLP

(57) ABSTRACT

A hot and cold vending machine. The vending machine may include a product compartment, a refrigeration system, and a ventilation system in communication with the refrigeration system and the product compartment. The ventilation system may include a valve positioned in communication with the product compartment. A heater may be positioned about the product compartment. The valve and the heater may be selectively activated such that product compartment may be hot or cold.

23 Claims, 3 Drawing Sheets

REMOVABLE REFRIGERATION CASSETTE FOR A HOT AND COLD VENDING MACHINE

TECHNICAL FIELD

The present invention relates generally to refrigeration and heating systems and more specifically relates to a removable refrigeration cassette for use with a vending machine with hot and cold vending compartments.

BACKGROUND OF THE INVENTION

Hot and/or cold vending machines are common in certain countries. For example, such vending machines are particularly popular in Japan. These vending machines typically have several compartments that can be run either hot or cold. The vending machines generally use a standard Rankine cycle refrigeration device. The overall refrigeration system may include evaporators in each compartment connected to the Rankine cycle device by valves and refrigeration lines. These valves may control which evaporators are "on", thereby controlling which compartments are cold. Each of the compartments also may have a heater. The heater may be turned on in any compartment with products that are to be vended hot.

One of the drawbacks with these vending machines is that the evaporators generally are fixed within their respective compartments. Likewise, the Rankine cycle device may be fixed within the overall enclosure. Removal or replacement of the refrigeration system or the individual components therein therefore may be difficult and time consuming.

Another drawback with known hot and cold vending machines is the use of the Rankine cycle device itself. For example, a Stirling cycle cooler may be desirable as compared to a Rankine cycle device because the Stirling cycle cooler is non-polluting, efficient, and has very few moving parts. The integration of Stirling cycle coolers into conventional refrigeration cabinets, however, requires different manufacturing, installation and operational techniques as compared to those used for conventional refrigeration systems. One example of the use of a Stirling cycle cooler is shown in commonly owned U.S. Pat. No. 6,581,389 B2, entitled, "Merchandiser using Slide-out Stirling Refrigeration Deck", incorporated herein by reference.

What is desired, therefore, is a hot and cold vending machine with an easily removable refrigeration system. Further, such a refrigeration system may be driven by a Stirling cycle cooler system, although a conventional Rankine cycle system or any type of known refrigeration system may be used.

SUMMARY OF INVENTION

The present invention thus provides a hot and cold vending machine. The vending machine may include a product compartment, a refrigeration system, and a ventilation system in communication with the refrigeration system and the product compartment. The ventilation system may include a valve positioned in communication with the product compartment. A heater may be positioned about the product compartment. The valve and the heater may be selectively activated such that product compartment may be hot or cold.

The hot and cold vending machine further may include a number of product compartments and the ventilation system may include a number of valves. The vending machine may have a number of hot compartments and a number of cold compartments. The product compartment may include a number of product bins. The product bins may include vents positioned therein. The product compartments may be positioned vertically or horizontally.

The ventilation system may include a supply air duct on a first side of the product compartment and a return air duct on a second side of the product compartment. A first valve may be positioned about the supply air duct and a second valve may be positioned about the return air duct. The valve may include a butterfly valve.

The refrigeration system may include a removable refrigeration cassette. The refrigeration system may include a refrigeration device. The refrigeration device may include a Stirling cycle cooler, a Rankine cycle device, or any similar type of device. The refrigeration system may include a heat exchanger in communication with the refrigeration device. The refrigeration system may include a fan positioned adjacent to the heat exchanger. The refrigeration system may include a ventilation pathway in communication with the ventilation system.

A further embodiment may provide for a hot and cold vending machine. The vending machine may include a number of product compartments, a refrigeration system, and a ventilation system in communication with the refrigeration system and the product compartments. The ventilation system may include a number of valves such that one or more of the valves are positioned about each of the product compartments. A heater may be positioned within each of the product compartments. The valves and the heaters may be selectively activated.

The hot and cold vending machine may have a number of cold compartments and a number of hot compartments. The refrigeration system may be removable.

A method of the present invention may provide for operating a vending machine with a number of product compartments. Each of the product compartments may include a heater therein. The vending machine may have a refrigeration system in communication with each of the product compartments via a ventilation system. The method may include the steps of determining which of the product compartments are to be hot and which of the product compartments are to be cold, opening or confirming that the ventilation system in communication with those product compartments that are to be cold is open, and closing or confirming that the ventilation system in communication with those product compartments that are to be hot is closed.

The method further may include the steps of turning on the heater in those product compartments that are to be hot and circulating chilled air from the refrigeration system through those product compartments that are to be cold via the ventilation system. The method also may include the steps of determining which of the product compartments are be at room temperature and closing or confirming that the ventilation system in communication with those product compartments that are to be at room temperature is closed.

These and other features of the present invention will become apparent upon review of the following detailed description when taken in conjunction with the drawings and the appended claims.

DETAILED DESCRIPTION

Figure 1:
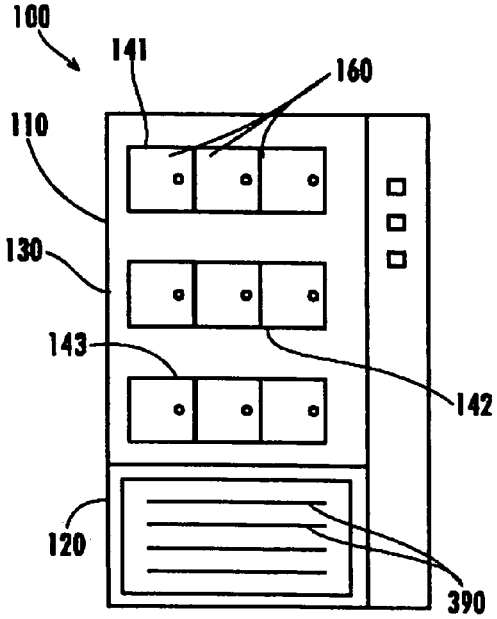
FIG. 1 is a front plan view of a hot and cold vending machine of the present invention.
Figure 2:
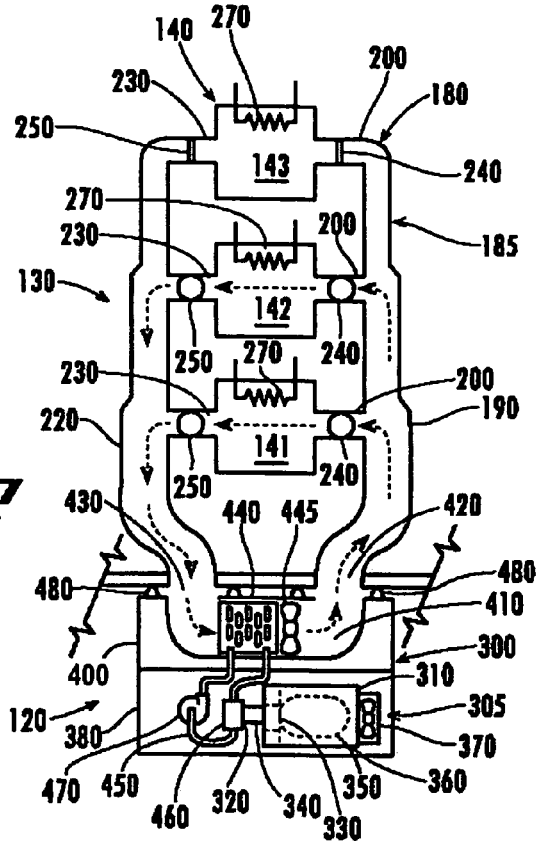
FIG. 2 is a front cross-sectional view of the hot and cold vending machine of FIG. 1.
Figure 3:
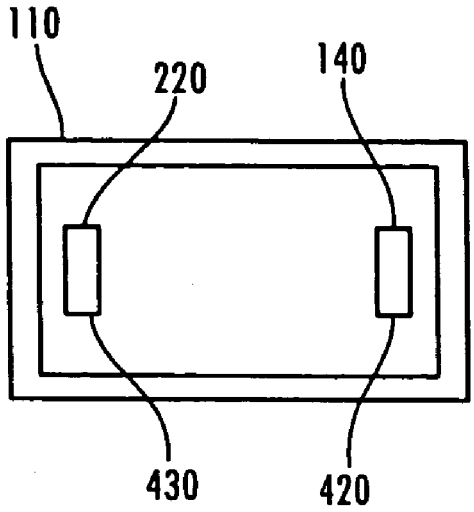
FIG. 3 is a top cross-sectional view of the hot and cold vending machine of FIG. 1.
Figure 4:
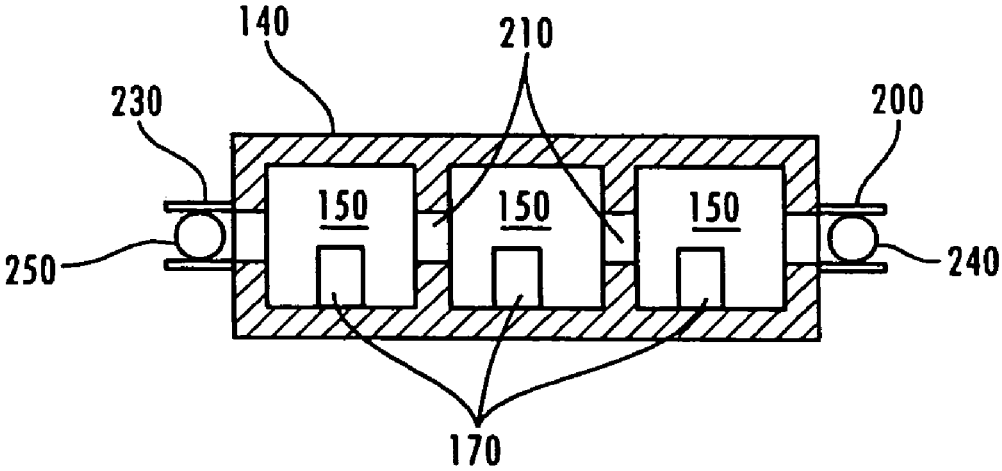
FIG. 4 is a side cross-sectional view of one of the compartments of the hot and cold vending machine of FIG. 1.

Referring now to the drawings, in which like numerals indicate like elements throughout the several views, FIGS. 1–4 show an example of a hot and cold vending machine 100 of the present invention. The hot and cold vending machine 100 may include an insulated shell 110. The insulated shell 110 may be made out of expanded polystyrene foam, polyurethane foam, or similar types of insulating materials. The insulated shell 110 may take any desired size or shape.

The insulated shell 110 may include a refrigeration cassette area 120 and a product area 130. The refrigeration components, as described in more detail below, may be positioned within the refrigeration cassette area 120. The refrigeration cassette area 120 and the product area 130 generally are in communication with one another so as to circulate chilled air from the refrigeration cassette area 120 through the product compartment 130 and back again.

The product area 130 may have a number of hot and cold vending compartments 140. By "hot and cold" vending compartments 140, we mean "hot and/or cold". In this example, three (3) hot and cold compartments 140 are shown, a first compartment 141, a second compartment 142, and a third compartment 143. Any number of hot and cold compartments 140 may be used. Each hot and cold compartment 140 in turn may be subdivided into any number of individual product bins 150. Each of the product bins 150 may have a door 160. Operation of the product doors 160 may be controlled in a conventional manner upon the payment of the appropriate amount of money or upon any other type of conventional triggering event.

A product or products 170 may be positioned within each product bin 150. The product 170 may be any type of dispensable item that is intended to be served hot, cold, or at room temperature. For example, a soft drink or an ice cream product may be offered cold; a coffee or a soup product may be offered hot; and potato chips, candy, or other types of items may be offered at room temperature.

The product area 130 may include a ventilation system 180 so as to circulate chilled air therethrough. The ventilation system 180 may include a number of insulated air ducts 185. The ducts 185 may be made out of plastic, metal, or similar types of materials. The air ducts 185 may include a supply air duct 190. The supply air duct may be in communication with the refrigeration cassette area 120. In turn, each hot and cold compartment 140 may have a supply compartment duct 200 in communication with the supply air duct 190. Any number of supply compartment ducts 200 may be used.

Each hot and cold compartment 140 also may have a number of internal vents 210 positioned between each of the product bins 150. The ventilation system 180 also may include a number of return compartment ducts 230 in communication with each hot and cold compartment 140. Any number of return compartment ducts may be used. The ventilation system 180 also may have a return air duct 220. The return air duct 220 may be in communication with each of the return compartment ducts 200 and the refrigeration cassette area 120.

The ventilation system 180 thus includes a pathway from the refrigeration cassette area 120 through the supply air duct 190, into each of the supply compartment ducts 200, through each hot and cold compartment 140, out each return compartment duct 230, through the return air duct 220, and back to the refrigeration cassette area. Any similar type of ventilation path or circulation scheme also may be used herein.

The ventilation system 180 also may include a supply air valve 240 positioned within each supply compartment duct 200 and a return air valve 250 positioned within each return compartment duct 230. The valves 240,250 may be a conventional butterfly valve 260. Specifically by use of the term "valve", we mean any type of on-or-off or open-and-shut damper or a similar type of device. Alternatively, each product bin 150 may have its own set of valves 240, 250.

Each hot and cold compartment 140 also may include a heater 270. The heater 270 may be any type of resistance heater or a similar type of device. The heater may be selectively activated. Further, the heater 270 only may be turned on when a hot product 170 is selected. Alternatively, each product bin 150 may have its own heater.

Positioned within the refrigeration cassette area 120 may be a refrigeration cassette 300. The refrigeration cassette 300 may include one or more refrigeration devices 305 positioned therein. The refrigeration device 305 may be a Stirling cycle cooler, a Rankine cycle device, a trans-critical carbon dioxide cycle system, or any other type of refrigeration system.

For example, the refrigeration device 305 may be a Stirling cycle cooler 310. One type of Stirling cycle cooler 310 that may be used herein is a free piston Stirling cooler. Such a Stirling cycle cooler 310 may be commercially available from Global Cooling, Inc. of Athens, Ohio under the designation "M100B". Similar types of devices also may be used herein.

The Stirling cycle cooler 310 may include an acceptor or a cold end 320 and a rejector or a hot end 330. A regenerator 340 may separate the cold end 320 from the hot end 330. As is known, the Stirling cycle cooler 310 may include a piston driven by a linear motor. The piston and the linear motor may be positioned within a shell 350 and a heat-rejection shroud 360 may surround the shell 350. A fan 370 or other type of air movement device may be positioned about the shroud 360. The fan 370 may direct a flow of ambient air across the hot end 330 of the Stirling cycle cooler 310. The functions of the Stirling cycle cooler 310 and its internal components are well known to those skilled in the art. The respective sizes and numbers of the Stirling cycle coolers 310 and the components therein may vary within the specific application and the operating environment of the hot and cold vending machine 100 as a whole.

The refrigeration cassette 300 itself may include a refrigeration device area. The refrigeration device 305 may be positioned within the refrigeration device area 380. The refrigeration device area 380 may include vents 390 or other types of inlets and outlets as appropriate that may communicate with the insulated shell 110 and the exterior thereof.

The refrigeration cassette 300 also may include an insulated area 400. The insulated area 400 may be made out of polyurethane foam, expanded polystyrene foam, or similar types of insulating materials. The insulated area 400 may include a ventilation pathway 410. The ventilation pathway 410 may have a cold air duct 420 in communication with the supply air duct 190 of the ventilation system 180 of the product area 130. The insulated area 400 also may have an exhaust air duct 430. The exhaust air duct 430 may be in communication with the return air duct 220 of the ventilation system 180 of the product area 130.

Also positioned within the ventilation pathway 410 of the insulated area 400 may be a heat exchanger 440. The heat exchanger 440 may be a conventional tube and fin type heat exchanger, a microchannel heat exchanger, or any similar type of heat exchange device. A fan 445 or a similar type of air movement device may be positioned within ventilation pathway 410 so as to circulate air therethrough.

The cold end 320 of the Stirling cycle cooler 310, or whatever refrigeration device 305 that may be used, may be positioned within a heat transfer loop 450 with the heat exchanger 440. Any type of conventional heat transfer loop 450 may be used. A conventional heat transfer fluid may be used therein. A refrigeration device heat exchanger 460 may be positioned about the refrigeration device 305. The heat exchanger 440 within the ventilation pathway 410 may be connected by the heat transfer loop 450 with the refrigeration device heat exchanger 460. The heat transfer loop 450 may circulate the heat transfer fluid therein via a pump 470 or other type of transfer device.

In the case of the Stirling cycle cooler 310, the heat transfer loop 450 may be in the form of a thermosiphon as described in detail in commonly-owned U.S. Pat. No. 6,550,255, incorporated herein by reference. Any similar type of heat transfer loop 450 may be used herein.

As described above, the refrigeration cassette 300 may be similar to that described in commonly owned U.S. Pat. No. 6,581,389, incorporated herein by reference. The refrigeration cassette 300 may be removable from the insulated shell 110 and the ventilation system 180. One or more seals 480 may be positioned about the ducts 420 or 430 so as to provide efficient airflow between the refrigeration cassette area 120 and the product area 130. The seals 480 may be made out of vinyl extrusion, elastomeric foam, or similar types of materials.

In use, a determination is made of which hot and cold compartments 140 may be hot, which may be cold, and which may be at room temperature. For example, it may be determined that the first compartment 141 and the second compartment 142 will be cold and that the third compartment 143 will be a hot. If so, then the valves 240, 250 within the compartment ducts 200, 230 are opened in the first and second compartments 141,142. Likewise, the valves 240, 250 in the compartment ducts 200, 230 of the third compartment 143 are closed.

The heater 270 within the third compartment 143 or within an individual product bin 150 then may be activated. Alternatively, the heater 270 may remain off until a particular product 170 is selected. The refrigeration device 305 also may be activated such that the refrigeration device 305 cooperates with the heat exchanger 440 via the heat transfer loop 450 to remove heat within the air passing through the ventilation pathway 410. The fan 445 then circulates the chilled air through the cold air duct 420, into the supply air duct 190, and into the supply compartment ducts 200 of the first and second compartments 141, 142. The chilled air then cools the products within the compartments 141, 142 and within each product bin 150. The exhaust air then exits the compartments 141, 142 via the return compartment air ducts 230, the return air duct 220,and back into the ventilation pathway 410 via the exhaust air duct 430.

Meanwhile, the closed valves 240, 250 within the compartment ducts 200, of the third compartment 143 isolate the third compartment 143 from the cold airflow. At least the valve 240 should be closed. The heater 270 may warm the products 170 within the product bins 150.

Each of the compartments 140 may be heated or chilled depending on the desired inventory of products 170 within the hot and cold vending machine 100. Likewise, one of the compartments 140 also may be maintained at room temperature by closing off the valves 240, 250 but not turning on the heater 270. The number of hot and cold compartments 140 may be altered between hot, cold, or room temperature at any time.

The refrigeration cassette 300 may be removed so as to make the refrigeration unit 305 easily accessible for replacement, repair, or maintenance. The ventilation system 180 and the product area 130 need not be disturbed.

Figure 5:
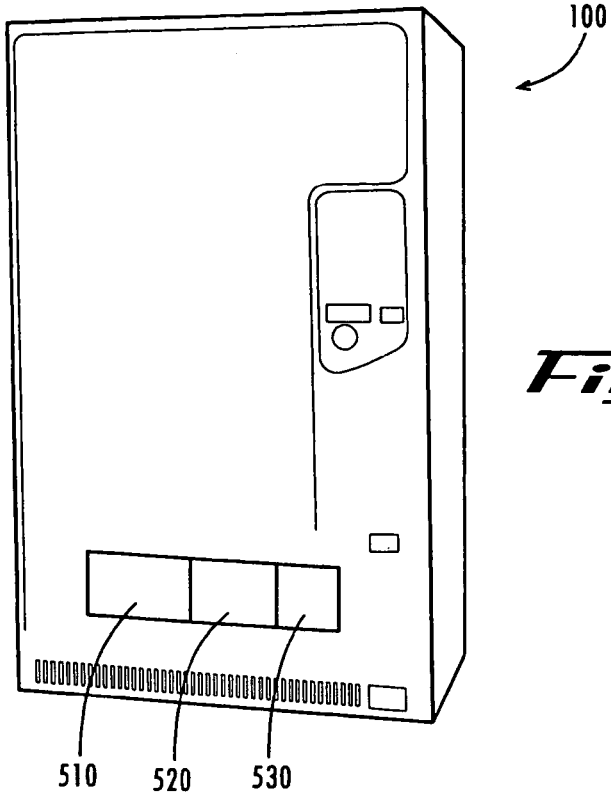
FIG. 5 is a perspective view of an alternative embodiment of a hot and cold vending machine.
Figure 6:
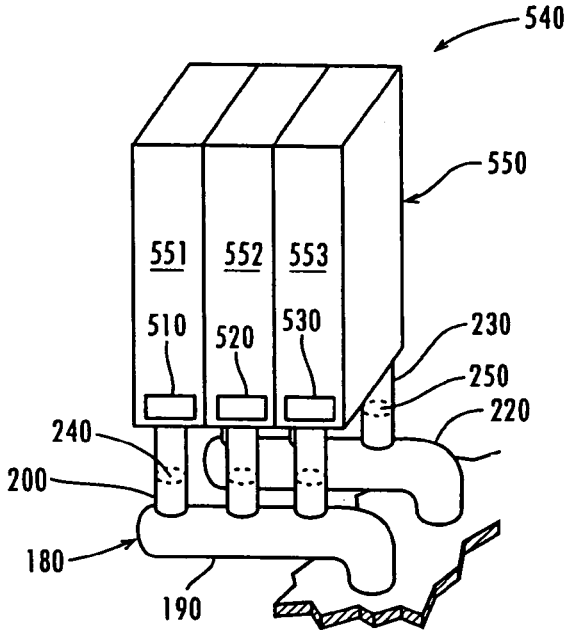
FIG. 6 is perspective view of a product area of the hot and cold vending machine of FIG. 5.

FIGS. 5 and 6 show an alternative embodiment, a hot and cold vending machine 500. The vending machine 500 is similar to the hot and cold vending machine 100 described above, but in this case the vending machine 500 has three vending areas 510, 520, 530. Hot or cold products 170 may drop into one of the vending areas 510, 520, 530. Any number of the vending areas 510, 520, 530 may be used.

FIGS. 6 shows a product area 540 of the vending machine 500. The product area 540 of the vending machine 500 also may have a number of hot and cold compartments 550. In this case, a first hot and cold department 551, a second hot and cold compartment 552, and a third hot and cold compartment 553. The hot and cold products 170 may be stacked vertically within each hot and cold compartment 550. Each hot and cold product compartment 550 may include a conventional drop mechanism so as to drop the hot or cold products 170 to the vending areas 510, 520, 530.

As described above, each hot and cold compartment 550 may be connected to the ventilation system 180. Specifically, the ventilation system 180 includes the circuit from the refrigeration cassette area 120 through the supply air duct 190, into each of the supply compartment ducts 200, through selected hot and cold compartment 550, out each return compartment duct 230, through the return air duct 220, and back to the refrigeration cassette area 120. A supply air valve 240 may be positioned within each supply compartment duct 200 and a return air valve 250 may be positioned within each return compartment duct 230. The valves 240, 250 may be open or shut so as to heat or cool each hot or cold compartment 550 as described above.

It should be apparent that the foregoing relates only to exemplary embodiments of the present invention and that numerous changes and modification may be made herein without departing from the spirit and scope of the invention as defined by the following claims and the equivalents thereof.

The invention claimed is:

1. A hot and cold vending machine, comprising:

a product compartment;

a refrigeration system;

wherein the refrigeration system comprises a removable refrigeration cassette;

a ventilation system in communication with the refrigeration system and the product compartment;

the ventilation system comprising a valve positioned in communication with the product compartment; and a heater positioned about the product compartment;

the valve and the heater being selectively activated such that product compartment may be hot or cold.

2. The hot and cold vending machine of claim 1, further comprising a plurality of product compartments and wherein the ventilation system comprises a plurality of valves.

3. The hot and cold vending machine of claim 1, further comprising a plurality of hot compartments and a plurality of cold compartments.

4. The hot and cold vending machine of claim 1, wherein the product compartment comprises a plurality of product bins.

5. The hot and cold vending machine of claim 4, wherein the plurality of product bins comprises a plurality of vents positioned therein.

6. The hot and cold vending machine of claim 1, wherein the ventilation system comprises a supply air duet on a first side of the product compartment and a return air duct on a second side of the product compartment.

7. The hot and cold vending machine of claim 6, wherein the ventilation system comprises a first valve positioned about the supply air duct and a second valve positioned about the return air duct.

8. The hot and cold vending machine of claim 1, wherein the valve comprises a butterfly valve.

9. The hot and cold vending machine of claim 1, wherein the refrigeration system comprises a refrigeration device.

10. The hot and cold vending machine of claim 9, wherein the refrigeration device comprises a Stirling cycle cooler.

11. The hot and cold vending machine of claim 9, wherein the refrigeration device comprises a Rankine cycle device.

12. The hot and cold vending machine of claim 9, wherein the refrigeration system comprises a heat exchanger in communication with the refrigeration device.

13. The hot and cold vending machine of claim 9, wherein the refrigeration system comprises a fan positioned adjacent to the heat exchanger.

14. The hot and cold vending machine of claim 1, wherein the refrigeration system comprises a ventilation pathway in communication with the ventilation system.

15. The hot and cold vending machine of claim 1, wherein the product compartment comprises a plurality of horizontal product compartments.

16. The hot and cold vending machine of claim 1, wherein the product compartment comprises a plurality of vertical product compartments.

17. A hot and cold vending machine, comprising:

a plurality of product compartments;

a refrigeration system;

a ventilation system in communication with the refrigeration system and the plurality of product compartments;

the ventilation system comprising a plurality of valves such that one or more of the valves are positioned about each of the plurality of product compartments; and a plurality of heaters such that one of the heaters is positioned within each of the plurality of the product compartments;

the plurality of valves and the plurality of heaters being selectively activated.

18. The hot and cold vending machine of claim 17, wherein the plurality of product compartments comprise a plurality of cold compartments and a plurality of hot compartments.

19. The hot and cold vending machine of claim 17, wherein the refrigeration system is removable.

20. A method of operating a vending machine with a number of product compartments, with each of the number of product compartments comprising a heater therein, and with the vending machine having a refrigeration system in communication with each of the product compartments via a ventilation system, the method comprising:

determining which of the product compartments are to be hot and which of the product compartments are to be cold;

opening or confirming that the ventilation system in communication with those product compartments that are to be cold is open; and closing or confirming that the ventilation system in communication with those product compartments that are to be hot is closed.

21. The method of claim 20, further comprising the step of turning on the heater in those product compartments that are to be hot.

22. The method of claim 20, further comprising the step of circulating chilled air from the refrigeration system through those product compartments that are to be cold via the ventilation system.

23. The method of claim 20, further comprising the steps of determining which of the product compartments are be at room temperature and closing or confirming that the ventilation system in communication with those product compartments that are to be at room temperature is closed.

* * * * *